US008418631B2

(12) United States Patent
Linares

(10) Patent No.: US 8,418,631 B2
(45) Date of Patent: Apr. 16, 2013

(54) PALLET DESIGN WITH BUOYANT CHARACTERISTICS

(75) Inventor: Miguel A. Linares, Bloomfield Hills, MI (US)

(73) Assignee: Oria Collapsibles, LLC, Auburn Hills, MI (US)

( * ) Notice: Subject to any disclaimer, the term of this patent is extended or adjusted under 35 U.S.C. 154(b) by 0 days.

(21) Appl. No.: 13/217,598

(22) Filed: Aug. 25, 2011

(65) Prior Publication Data

US 2012/0048169 A1 Mar. 1, 2012

Related U.S. Application Data

(60) Provisional application No. 61/377,205, filed on Aug. 26, 2010.

(51) Int. Cl.
*B65D 19/00* (2006.01)

(52) U.S. Cl.
USPC ..... 108/51.11; 108/54.1

(58) Field of Classification Search ..... 108/51.11, 108/54.1, 55.1, 53.1; 248/346.02, 346.2; 206/386, 599; 414/676; 180/124, 125
See application file for complete search history.

(56) References Cited

U.S. PATENT DOCUMENTS

| | | | | | |
|---|---|---|---|---|---|
| 3,015,470 | A | * | 1/1962 | Patchen | 254/93 HP |
| 3,161,247 | A | * | 12/1964 | Mackie | 180/124 |
| 3,267,882 | A | * | 8/1966 | Rapson et al. | 108/51.11 |
| 3,276,530 | A | * | 10/1966 | Borneman | 180/124 |
| 3,351,027 | A | * | 11/1967 | Ellard, Jr. et al. | 108/57.12 |
| 3,379,271 | A | * | 4/1968 | Hopkins et al. | 180/128 |
| 3,440,976 | A | * | 4/1969 | Burne | 108/51.11 |
| 3,513,934 | A | * | 5/1970 | Crowley | 180/124 |
| 3,756,342 | A | * | 9/1973 | Burdick | 180/124 |
| 3,760,899 | A | * | 9/1973 | Crossman et al. | 180/125 |
| 4,272,856 | A | * | 6/1981 | Wegener et al. | 5/81.1 T |
| 4,312,152 | A | | 1/1982 | Drury et al. | |
| 4,417,639 | A | * | 11/1983 | Wegener | 180/125 |
| 4,520,746 | A | | 6/1985 | Walters et al. | |
| 4,832,562 | A | * | 5/1989 | Johnson | 414/661 |
| 5,067,189 | A | * | 11/1991 | Weedling et al. | 5/81.1 R |
| 5,755,162 | A | * | 5/1998 | Knight et al. | 108/53.1 |
| 7,238,073 | B2 | | 7/2007 | Hendrickson | |
| 8,047,886 | B1 | | 11/2011 | McLarty et al. | |
| 2001/0050035 | A1 | * | 12/2001 | Mahnken | 108/57.12 |
| 2006/0191465 | A1 | | 8/2006 | Marcellus | |
| 2011/0240800 | A1 | | 10/2011 | Fox, Jr. | |

FOREIGN PATENT DOCUMENTS

DE 19541243 A1 5/1997

* cited by examiner

*Primary Examiner* — Jose V Chen
(74) *Attorney, Agent, or Firm* — Gifford, Krass, Sprinkle, Anderson & Citkowski, P.C.; Douglas J. McEvoy

(57) ABSTRACT

A body having a buoyant inducing element for supporting upon a body of water. The buoyant inducing element includes a plurality of bladders deployable into an end-to-end perimeter extending arrangement relative to the body. In a further design, a pressurized tank is contained within the body and holds a volume of a compressed gas and in communication with the deployable bladders. The body may also include upper and lower vertically displaceable halves, with the elevation of the upper half causing one way air inlet valves disposed within a bottom surface of the lower halve to fill an expanded interior defined between the halves, via vacuum inlet pressure acting upon the one way valves.

13 Claims, 22 Drawing Sheets

FIG. 19A
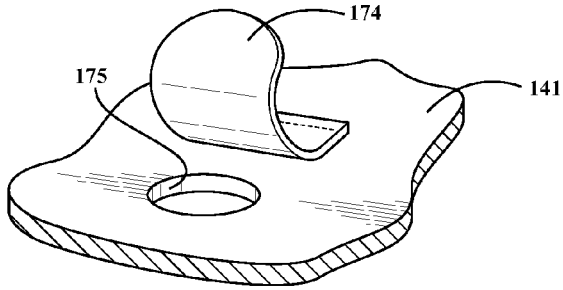
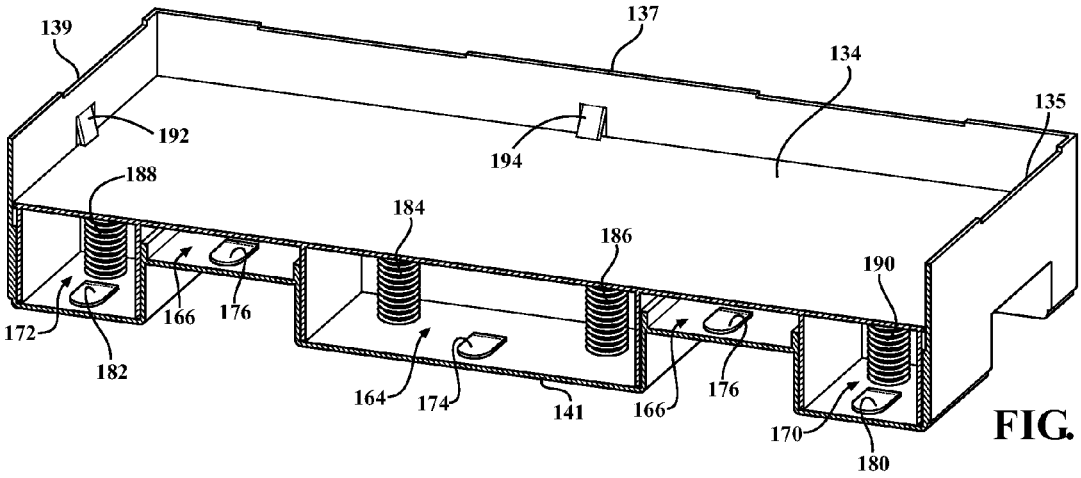
FIG. 19B

PALLET DESIGN WITH BUOYANT CHARACTERISTICS

CROSS-REFERENCE TO RELATED APPLICATIONS

This Application claims the benefit of U.S. Provisional Application 61/377,205 filed on Aug. 26, 2010.

FIELD OF THE INVENTION

The present invention discloses a number of variations of buoyant pallet designs, including any variation of wooden, composite wooden, paperboard, composite paperboard, plastic, composite plastic or other material exhibiting any shape or size. More particularly, the present invention includes a number of variations of improved pallet design exhibiting moisture sealant, fire retardant and, notably, buoyant characteristics including further the incorporation of inflatable bladders for providing weight supporting and buoyancy aspects such as during being launched from a ship or dropped from an aircraft.

DESCRIPTION OF THE PRIOR ART

Wooden pallet constructions are well known in the prior art. Problems associated with wooden pallets include degradation of material construction and load bearing capabilities, such also resulting from the pallets becoming wet (and excessively heavy) and degrading over time. Additional problems include the inability to maintain in stacked arrangement volumes of pallets during non-use periods as well as during transport between locations. A further shortcoming of known pallet designs is their inability to function effectively in a combined load carrying and flotation assisting manner, such as when it is desirous to transport a supported load upon a body of water or in a further potential application as an emergency flotation support device, such as for use by personnel.

SUMMARY OF THE PRESENT INVENTION

The present invention discloses a three dimensional shaped body with a buoyant inducing element incorporated therein body and which is deployed in order to support the body upon a body of water. In one variant, the buoyant inducing element further includes a plurality of bladders deployable into an end-to-end perimeter extending arrangement relative to the body. In a further design, a pressurized tank is contained within the body and holds a volume of a compressed gas and in communication with the deployable bladders. In a further variant, the body includes upper and lower vertically displaceable halves, with the elevation of the upper half causing one way air inlet valves disposed within a bottom surface of the lower halve to fill an expanded interior defined between the halves, via vacuum inlet pressure acting upon the one way valves.

Additional features include the bladders in their pre-expanded position being retracted within perimeter defined edges of the body and connected by a plurality of communicating lines to the pressurized tank. A plurality of slots can be disposed upon each of the side or underside edges of the body for facilitating outward inflation/expansion of the bladders in surrounding and/or underside supporting fashion relative to the body. A pluralities of perimeter defining bottom edges extending along each body each exhibiting locating inwardly stepped edge-notches, with corresponding pluralities of upper perimeter edges extending ridge sections associated with additional and identically constructed bodies seating the bottom recessed edge notches of a preceding body to maintain any plurality of pallets in secure and vertically stacked fashion.

BRIEF DESCRIPTION OF THE DRAWINGS

Reference will now be made to the attached drawings, when read in combination with the following detailed description, wherein like reference numerals refer to like parts throughout the several views, and in which:

FIG. 19A illustrates a representative air valve construction such as incorporated into the variant of FIG. 19 and including a vacuum intake opening and internally pressurized closing upper portion positioned relative to a floor situated aperture defined in a lower body half;

FIG. 19B is a cutaway illustration similar to FIG. 19 and depicting a further potential variant in which a plurality of expandable springs are incorporated into the pallet assembly between the upper and lower halves and in which the halves are maintained in a pre-expanded position by a plurality of perimeter spaced catch or tab portions established between the inwardly facing sides of the lower half and the elevatable edges of the upper half;

DETAILED DESCRIPTION OF THE PREFERRED EMBODIMENTS

As previously described, the present invention discloses a number of variations of buoyant pallet designs exhibiting moisture sealant, fire retardant and, notably, buoyant characteristics which include the incorporation of inflatable bladders or other internal architecture for providing combined cargo supporting and buoyancy aspects upon a body of water, such as during the pallet being launched from a ship or dropped from an aircraft with or without a pre-loaded volume of cargo. In a further potential application, the buoyant pallet construction can operate as an emergency flotation support device, such as for seaborne or airborne personnel.

Figure 1:
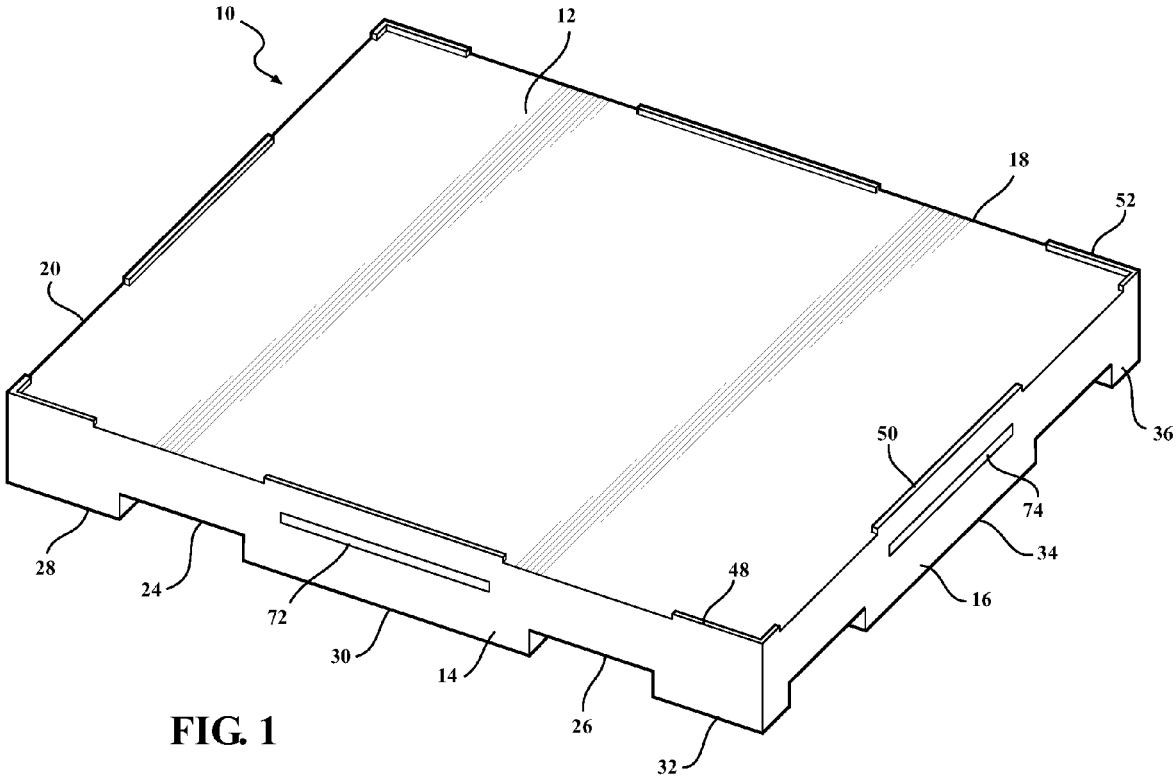
FIG. 1 is a perspective illustration of a buoyant inflatable pallet construction in a pre-expanded position and according to another variant of the invention.

Referring initially to FIG. 1, a perspective illustration is generally depicted at 10 of an initial version of buoyant inflatable pallet construction in a pre-expanded position. The pallet 10 exhibits a generally three dimensional and elongated shape with a substantially level or planar top 12, four interconnected sides 14, 16, 18 and 20 and an uneven bottom (depicted in cooperation with each of FIGS. 1-5 and including a maximum depth central location 22 as shown in phantom in FIG. 3, reduced depth intermediate locations 24 and 26, and outer most located and likewise maximum depth locations 28, 30, 32, 34, 36, 38, 40, and 42 (see as best shown in substantially transparent illustration FIG. 13).

The pallet can further be constructed, without limitation, of any suitable material for providing the necessary structural and environmental characteristics and in one non-specific application can include a polymeric or polymeric composite body which is constructed of any number of molded components which are subsequently assembled together. The pallet can also exhibit, without limitation, any type of material not limited to cardboard or corrugated paperboard core construction which is coated with a plasticized spray.

Figure 2:
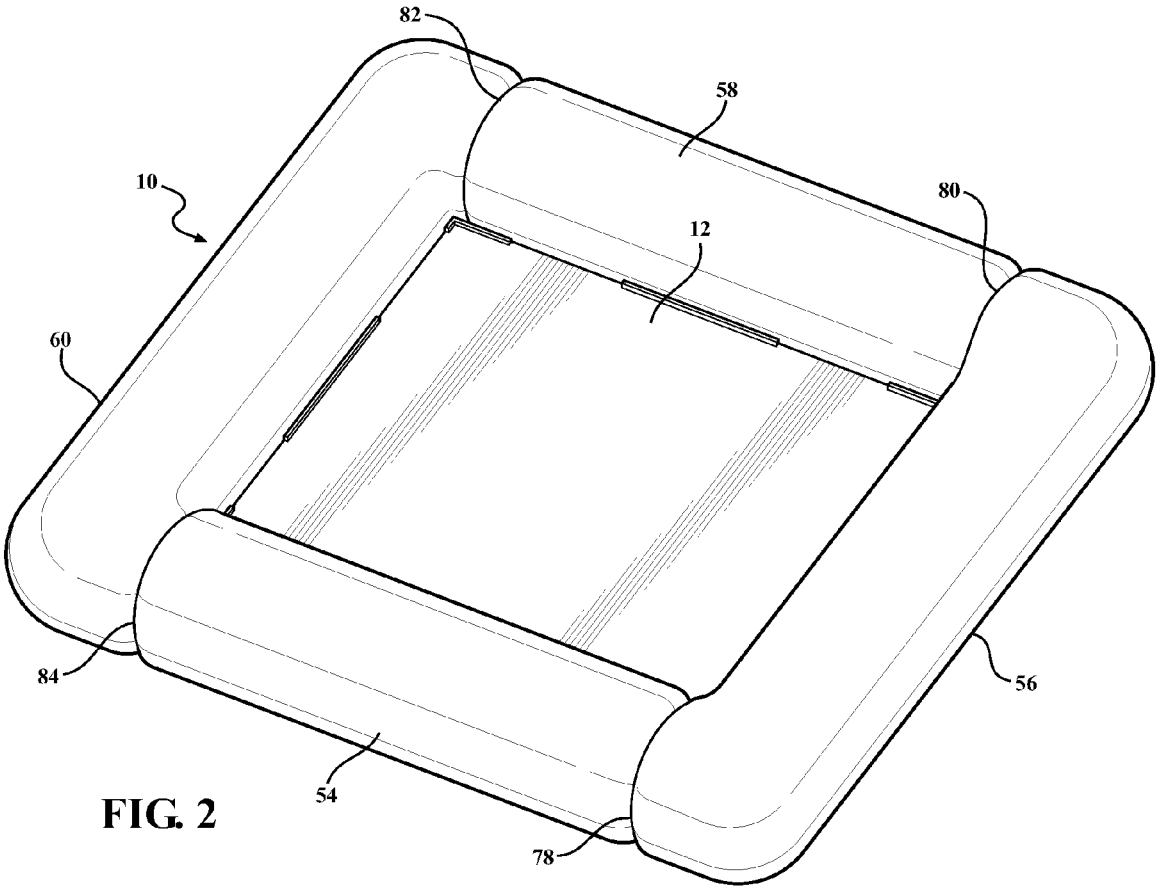
FIG. 2 is a post expanded illustration of the buoyant pallet in FIG. 1 and further depicting a perimeter extending arrangement of actuated and buoyant inducing bladders.

As further indicated, the perimeter defining bottom edges of the outer locations 28-42 can exhibit locating recesses or inwardly stepped edge-notches (see in particular as depicted at 44 associated with outer bottom edge section 36 and further at 46 for outer edge section 42). The pallet further exhibits a plurality of upper perimeter edge spaced apart central and corner ridge sections (at 48, 50, 52 et seq.) these seating with the bottom recessed edge notches to maintain a plurality of vertically stacked pallets 10 in secure fashion. FIG. 2 is a post expanded illustration of the buoyant pallet in FIG. 1 and further depicting a perimeter extending arrangement of actuated and buoyant inducing bladders which includes first 54, second 56, third 58 and fourth 60 side edge extending bladders. Without limitation, the bladders can include any heavy duty and flexible air or gas retaining material such as a heavy duty polymeric/rubberized or composite composition, and such as which can be expanded by a pressurized gas charge and which are sufficiently puncture resistant to maintain inflation in a dynamic environment.

Figure 13:
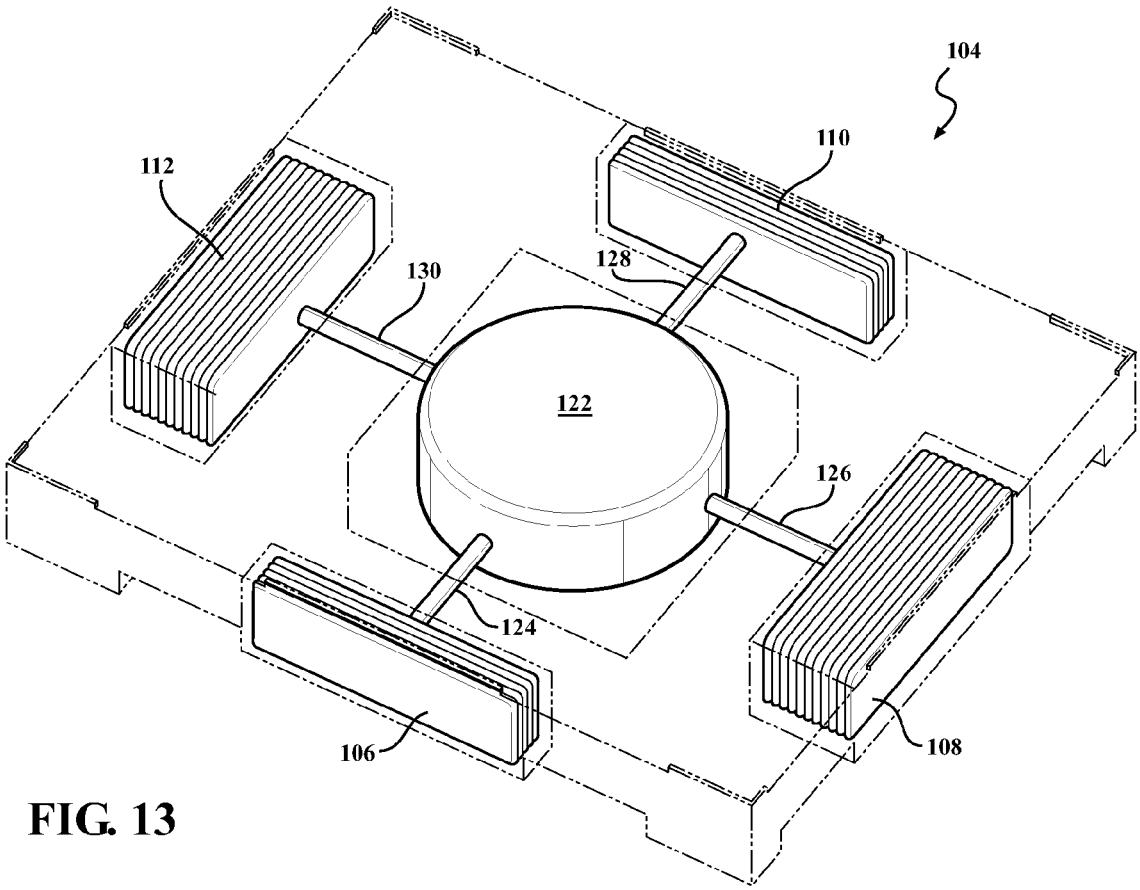
FIG. 13 is a substantially transparent illustration in perspective of the pallet in FIG. 11 and further illustrating a plurality of bottom edge extending bladders in pre-expanded position which are supplied by a central located compressed air or $CO^2$ charged cylinder, tank or canister.
Figure 14:
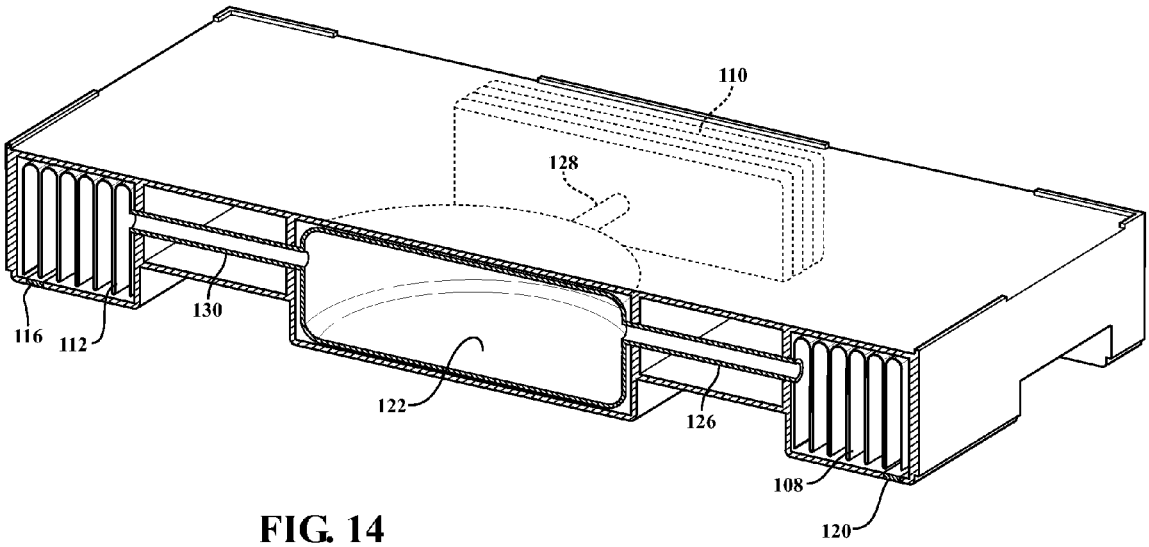
FIG. 14 is a lengthwise cutaway of FIG. 13 and further illustration the interior configuration of the charged cylinder or tank in communication with a plurality of bottom edge deployable bladders.

As further depicted in the pre-deployed and substantially transparent illustration in FIG. 13, the bladders 54, 56, 58 and 60 are stored within interior chambers defined within outer sections or locations coinciding with the bottom edge locations 30, 34, 38 and 42. The bladders in their pre-expanded position are retracted within perimeter defined edges of the body and are connected to an internally supported (such as ideally a central located) tank supporting a volume of a compressed gas, and such as without limitation an air or $CO^2$ charged cylinder, tank or canister (see as shown at 62), with a plurality of communicating lines 64, 66, 68 and 70 (again FIG. 3 as well as lengthwise cutaway of FIG. 4) extending to each of the respective bladders 54, 56, 58 and 60.

A plurality of four side disposed slots, three of which are evident at 72 (front side) and 74 & 76 (opposite and parallel ends with 76 shown in FIG. 4 cutaway), with a fourth identical slot associated with rear edge in FIG. 1 being hidden from view. Upon actuating the pressurized tank or $CO^2$ charge, the bags or bladders 54, 56, 58 and 60 are expanded from their original positions of FIGS. 3-4 to expanded, perimeter extending and edge to edge bias connecting fashion (reference further being made to opposing and inter-biasing edge connections 78 (between bladders 54 and 56), 80 (between bladders 56 and 58), 82 (between bladders 58 and 60) and 84 (between bladders 60 and 54) as depicted in FIG. 2 as well as the cutaway view of FIG. 4.

Without limitation, the bladders or bags can include any type of puncture resistant and resilient/flexible/expandable material including any composition possessing the necessary properties. The shaping of the pallet can also include any alternate configuration not limited to that shown, and it is also understood that any suitable mechanism, including automatic and water sensitive deployment, cam be incorporated into the pallet design for triggering pressurized fluid (such as air) from the central tank to inflate the outer positioned bladders. The scale of the pallet is also modifiable to suit any application, with upper sizes not limited to supporting upwards of 24,000 lbs or more of supported cargo.

Figure 6:
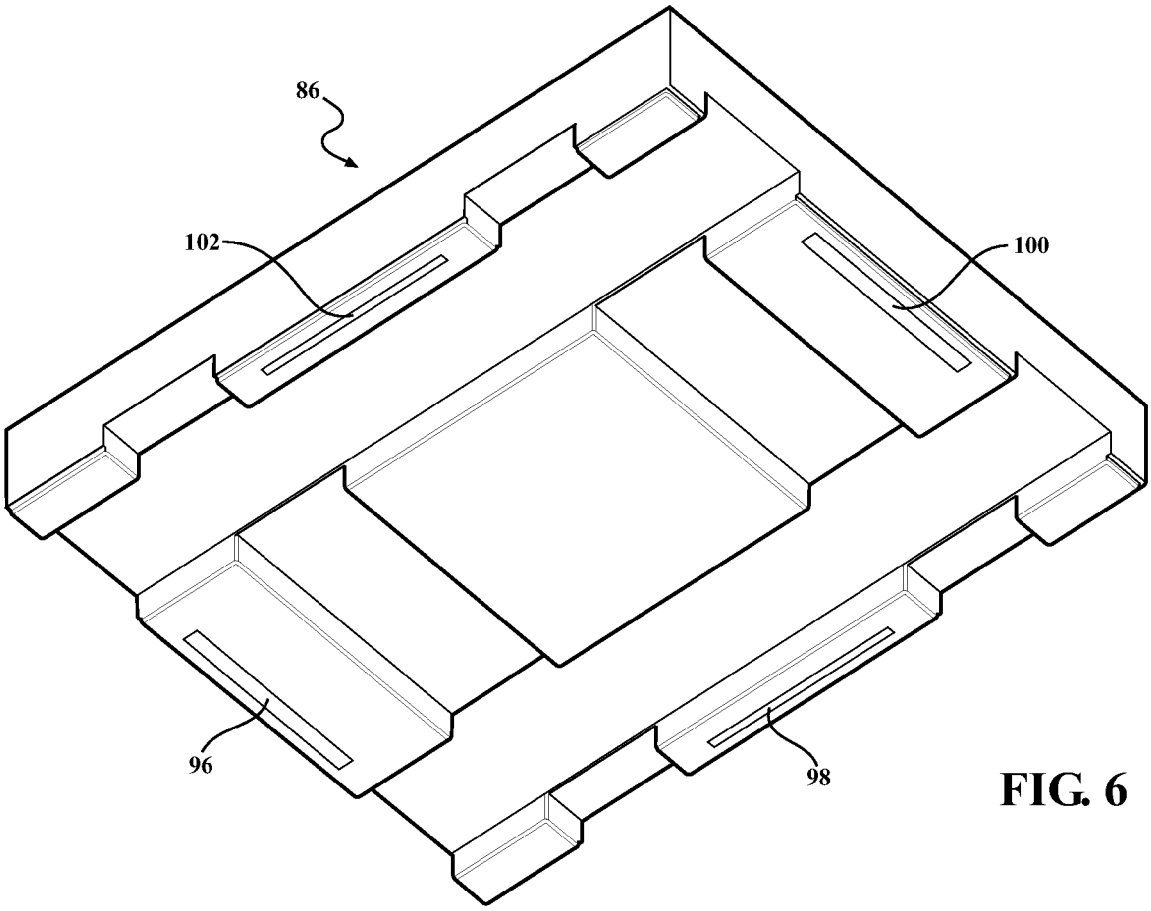
FIG. 6 is an underside looking perspective of a buoyant inflatable pallet construction in a pre-expanded position and according to another variant of the invention in which the perimeter spaced bladders are designed to deploy downwardly.

FIG. 6 is an underside looking perspective, generally at 86, of a buoyant inflatable pallet construction in a pre-expanded position and according to another variant of the invention in which the perimeter spaced bladders are designed to deploy downwardly. As with the further variants of FIGS. 11 and 16, the design of the pallet 86 is generally the same as depicted in detail in FIG. 1, such that a repetitive description is unnecessary. As equally applicable to each of the succeeding variants, the non-limiting nature of the pallet material construction is again reiterated.

Figure 3:
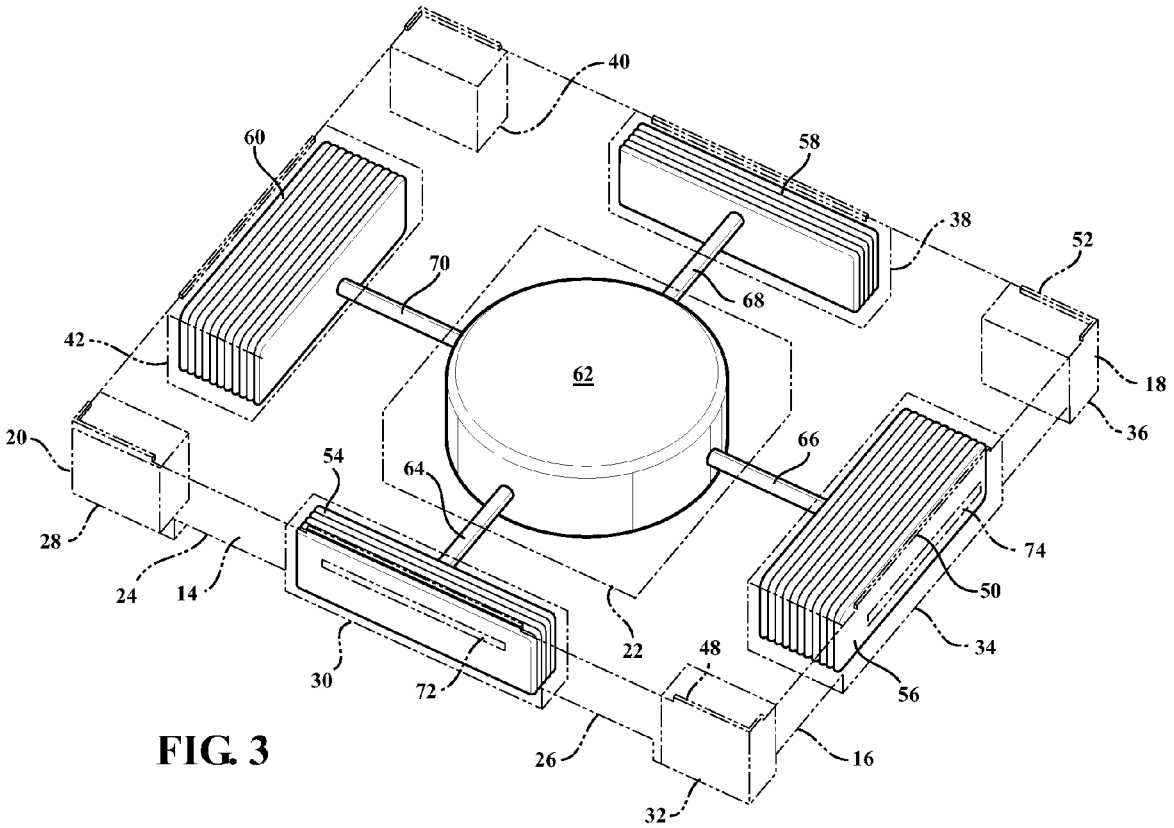
FIG. 3 is a substantially transparent illustration in perspective of the pallet in FIG. 1 and further illustrating a plurality of edge extending bladders in pre-expanded position which are supplied by a central located compressed air or $CO^2$ charged cylinder, tank or canister.
Figure 4:
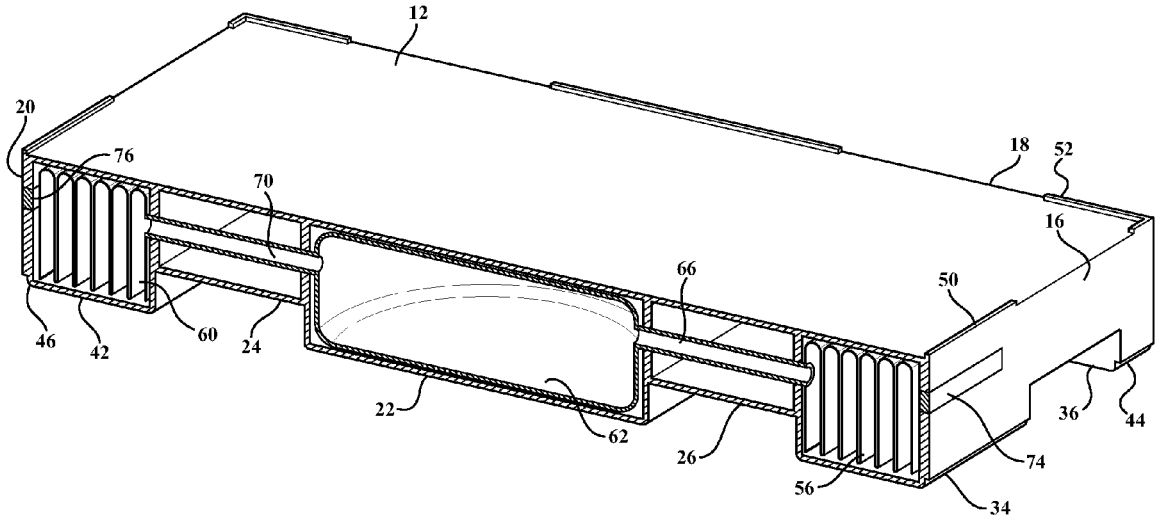
FIG. 4 is a lengthwise cutaway of FIG. 3 and further illustration the interior configuration of the charged cylinder or tank in communication with a pair of edge located inflatable bladders.
Figure 5:
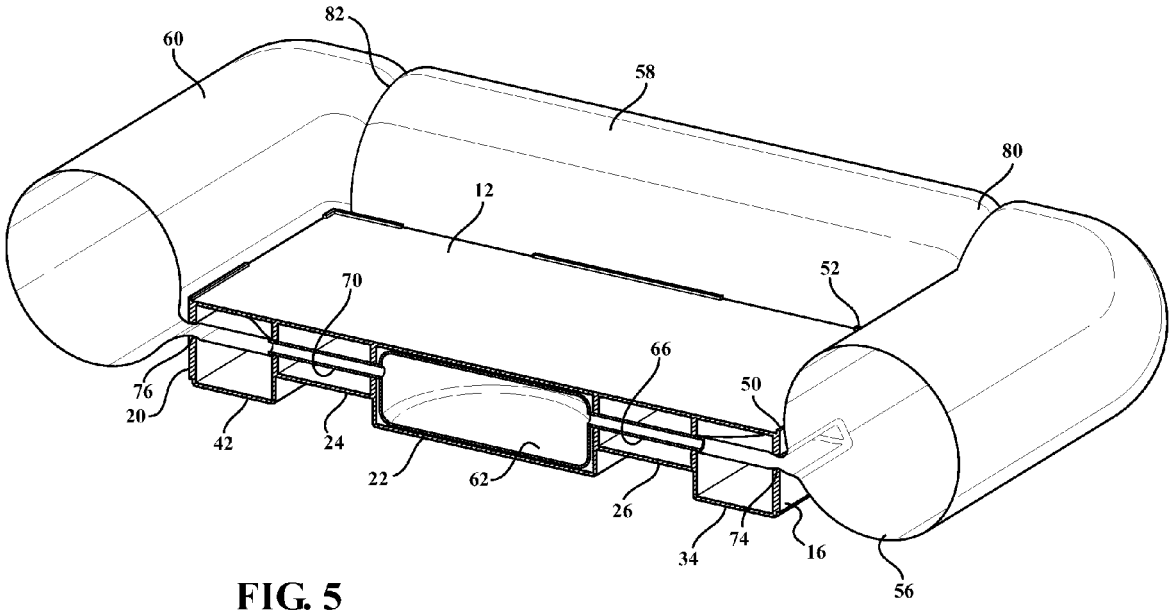
FIG. 5 is an identical cutaway view of FIG. 4, in the expanded position of FIG. 12, and illustrating the configuration of the expanded bladders which are further designed to bias in end-to-end deployed and perimeter surrounding fashion.
Figure 7:
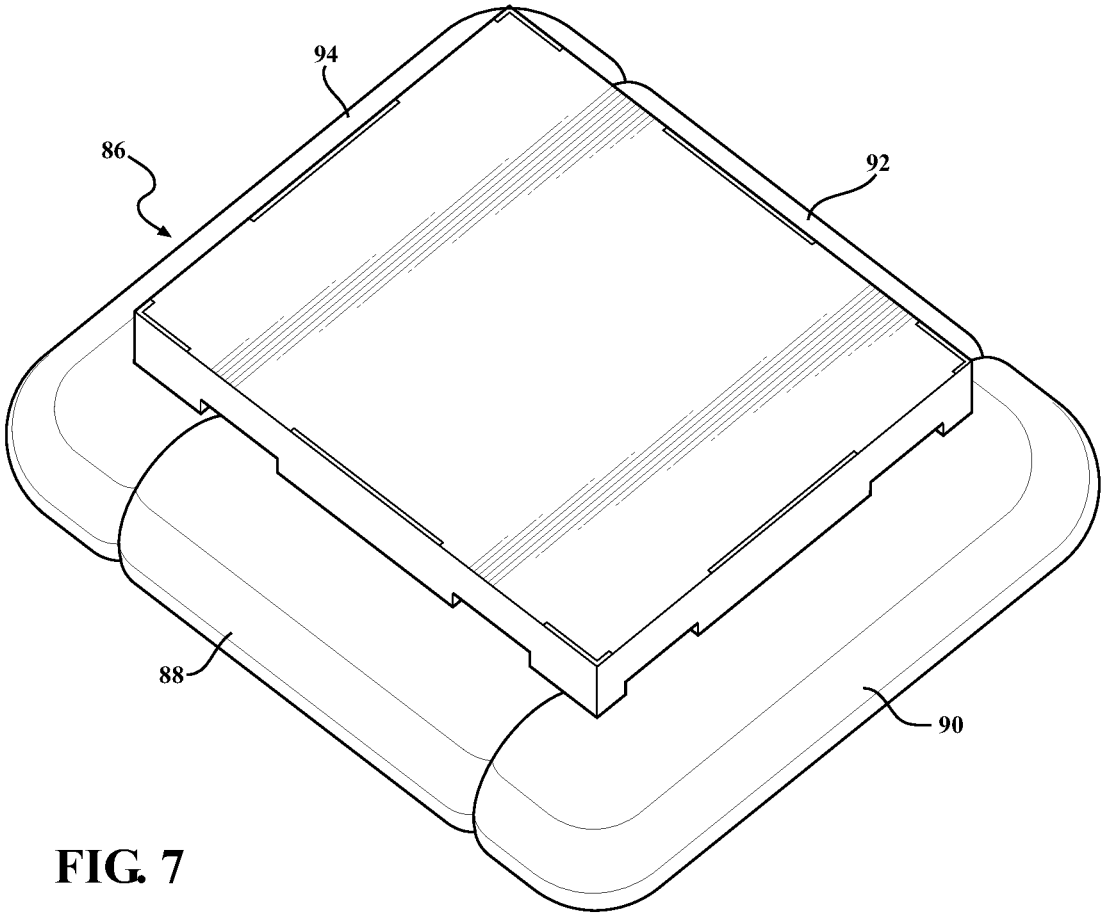
FIG. 7 is a post expanded illustration of the buoyant pallet in FIG. 6 and further depicting a perimeter extending arrangement of downward actuated and buoyant inducing bladders.

Referring to FIG. 7, a post expanded illustration of the buoyant pallet 86 in FIG. 6 is depicted and in which an alternate arrangement of deployable bladders 88, 90, 92 and 94 which are positioned in similar pre-deployed fashion as shown in FIG. 3 and which are capable of being actuated in a modified side to downwardly perimeter edge extending fashion, this occurring through lower edge slots 96, 98, 100 and 102 best depicted in FIG. 6.

Figure 8:
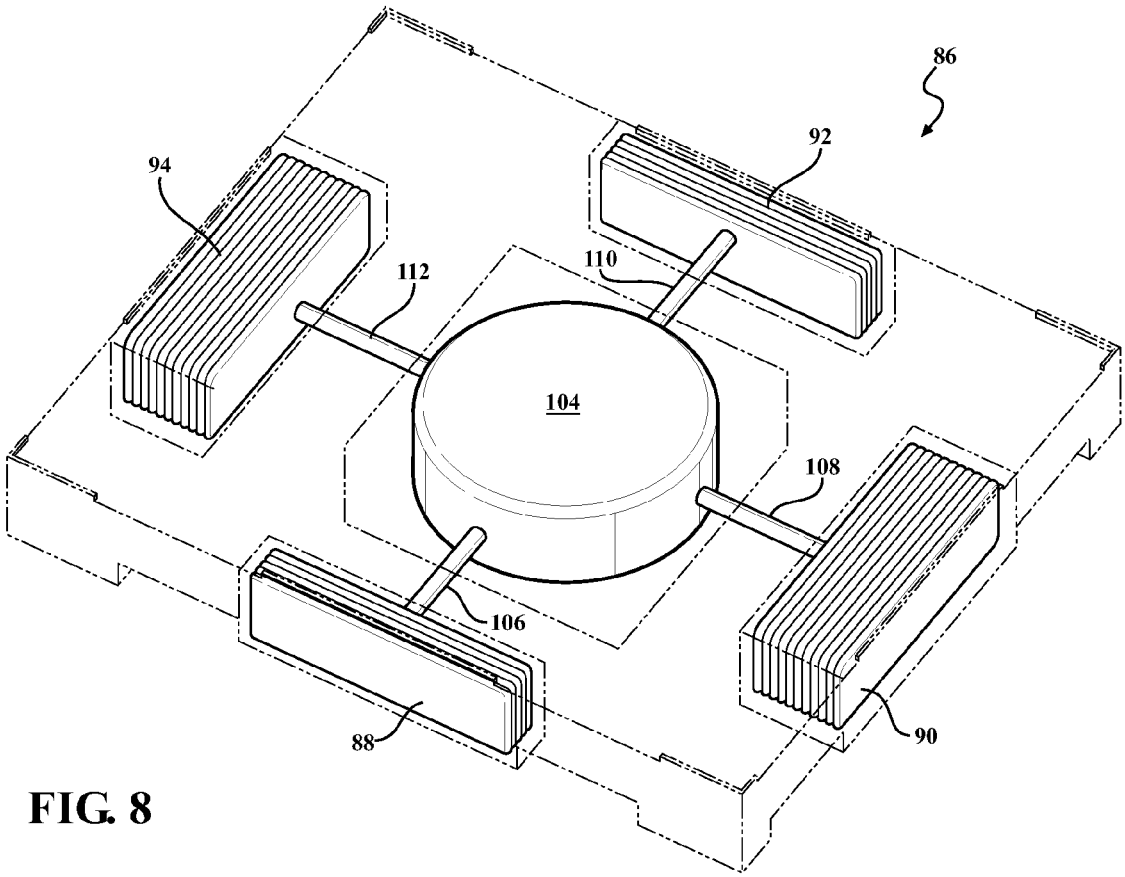
FIG. 8 is a substantially transparent illustration in perspective of the pallet in FIG. 6 and further illustrating a plurality of bottom edge extending bladders in pre-expanded position which are supplied by a central located compressed air or $CO^2$ charged cylinder, tank or canister.

FIG. 8 is a substantially transparent illustration in perspective of the pallet in FIG. 6, generally identical in construction to that previously shown in FIG. 3, and further illustrating the plurality of side to bottom edge proximate extending bladders 88, 90, 92 and 94 in pre-expanded position which are again supplied by a central located compressed air or $CO^2$ charged cylinder, tank or canister. As previously described, the bladders in their pre-expanded position are connected to a central located compressed air or $CO^2$ charged cylinder, tank or canister, see as shown at 104, by a plurality of communicating lines 106, 108, 110 and 112 (again FIG. 8 as well as lengthwise cutaway views of FIGS. 9-10).

Figure 9:
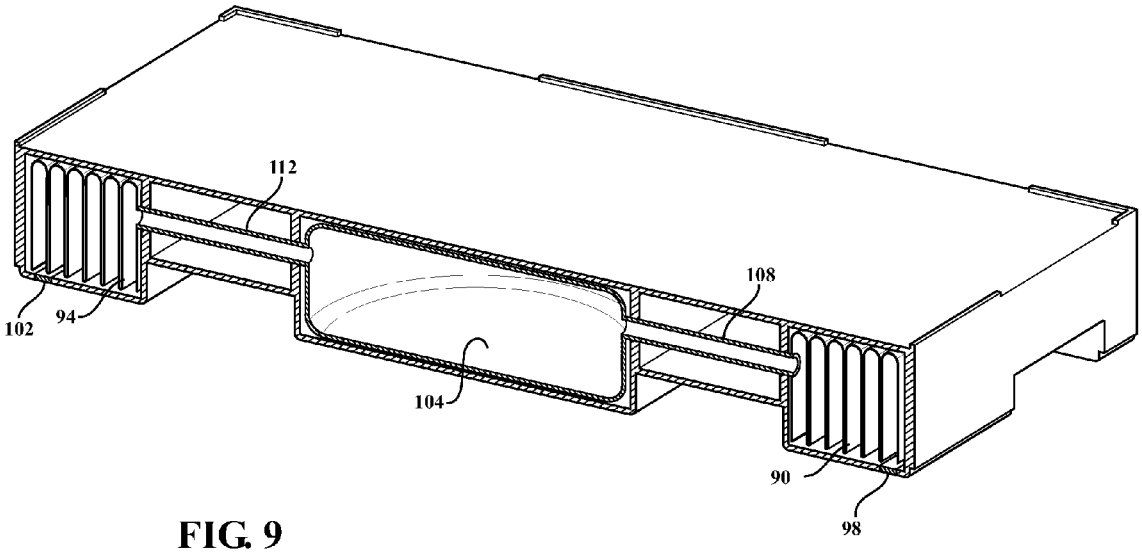
FIG. 9 is a lengthwise cutaway of FIG. 8 and further illustration the interior configuration of the charged cylinder or tank in communication with a pair of bottom edge deployable bladders.
Figure 10:
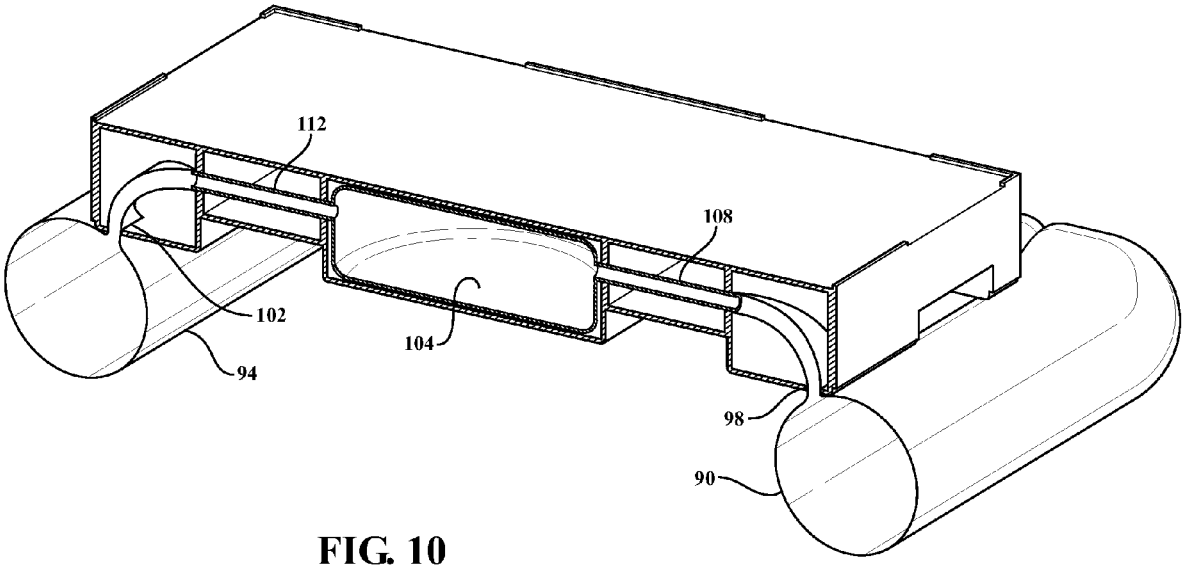
FIG. 10 is an identical cutaway view of FIG. 9, in the expanded position of FIG. 7, and illustrating the configuration of the expanded bladders which are again designed to bias in end-to-end deployed and perimeter surrounding fashion.

FIG. 9 is a lengthwise cutaway of FIG. 8 and further illustration the interior configuration of the charged cylinder or tank in communication with a pair of bottom edge deployable bladders and FIG. 10 is an identical cutaway view of FIG. 9, in the expanded position of FIG. 7, and illustrating the configuration of the expanded bladders which are again designed to bias in end-to-end deployed and perimeter surrounding fashion. The remaining structural features of the pallet 86 are substantially the same as previously described in reference to the pallet 10 in FIG. 1 such that a repetitive description is unnecessary.

Figure 11:
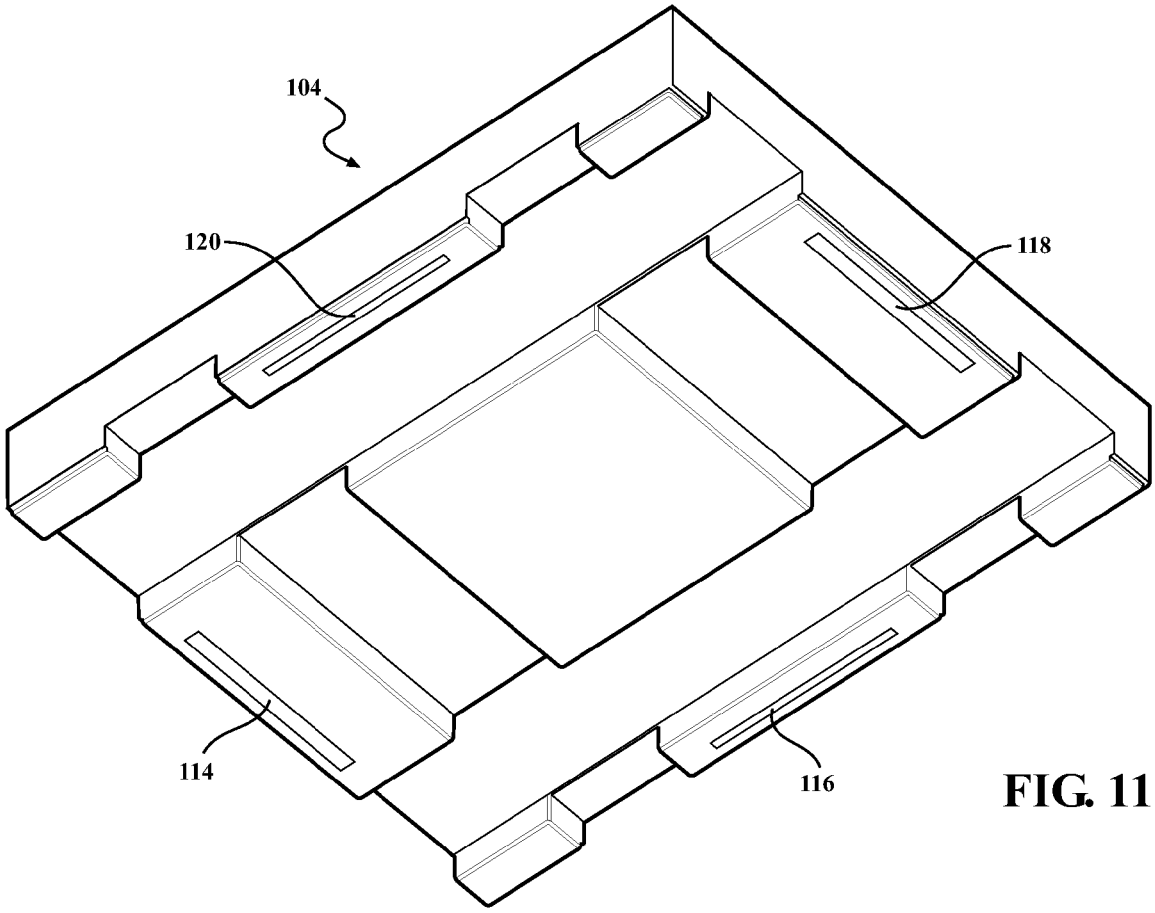
FIG. 11 is an underside looking perspective of a buoyant inflatable pallet construction in a pre-expanded position and according to a modified sub variant of the invention, in comparison to that shown in FIG. 16, and in which the perimeter spaced bladders are designed to deploy in a fully downwardly extending direction.
Figure 12:
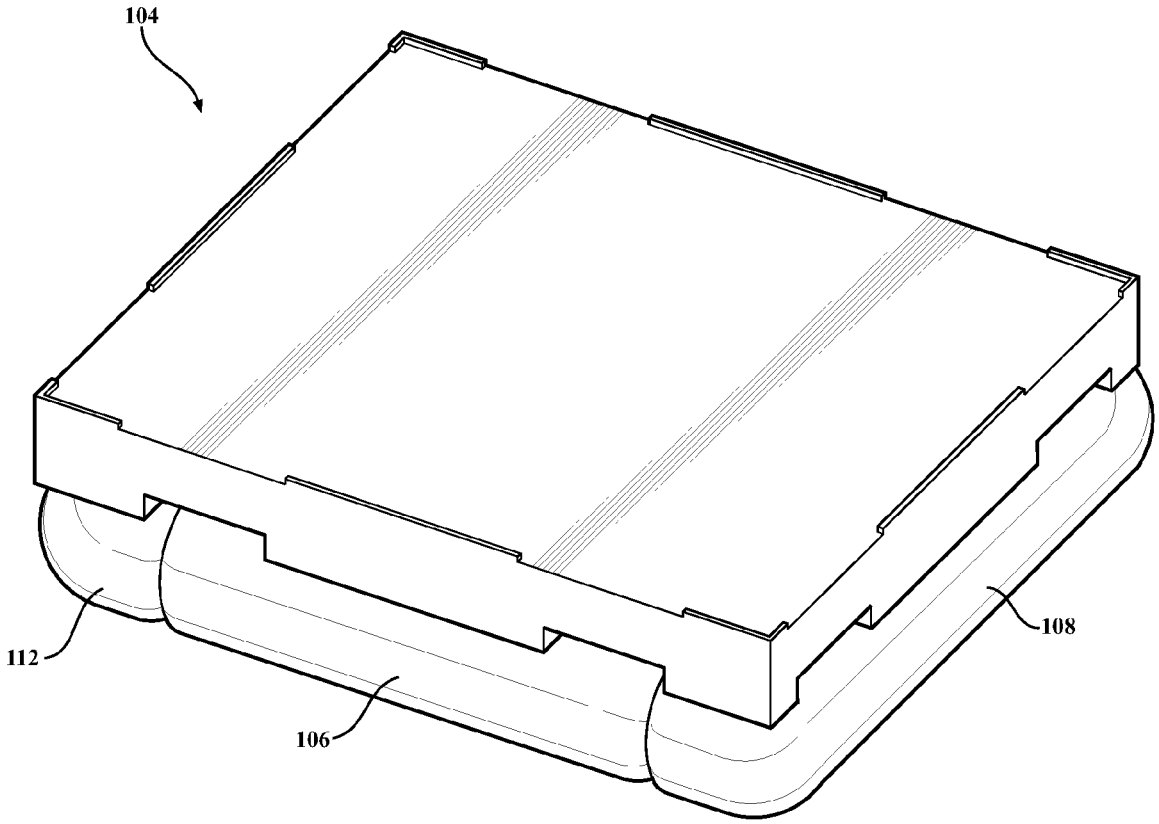
FIG. 12 is a post expanded illustration of the buoyant pallet in FIG. 11 and further depicting a perimeter extending arrangement of fully downward actuated and buoyant inducing bladders.

Proceeding to FIG. 11, an underside looking perspective is generally shown at 104 of a buoyant inflatable pallet construction in a pre-expanded position and according to a modified sub variant of the invention, in comparison to that shown at 86 in FIG. 6, and in which a further incorporated plurality of perimeter spaced bladders 106, 108, 110 and 112 are designed to deploy in a fully downwardly extending direction through a plurality of repositioned bottom facing and interconnecting edge proximate slots 114, 116, 118 and 120 (see FIG. 11). FIG. 12 is a post expanded illustration of the buoyant pallet in FIG. 11 and further depicts the downward redirection of the perimeter extending and fully deployed buoyant inducing bladders 106, 108, 110 and 112 (contrast to position of bladders 88, 90, 92 and 94 in FIGS. 7 and 10).

Figure 15:
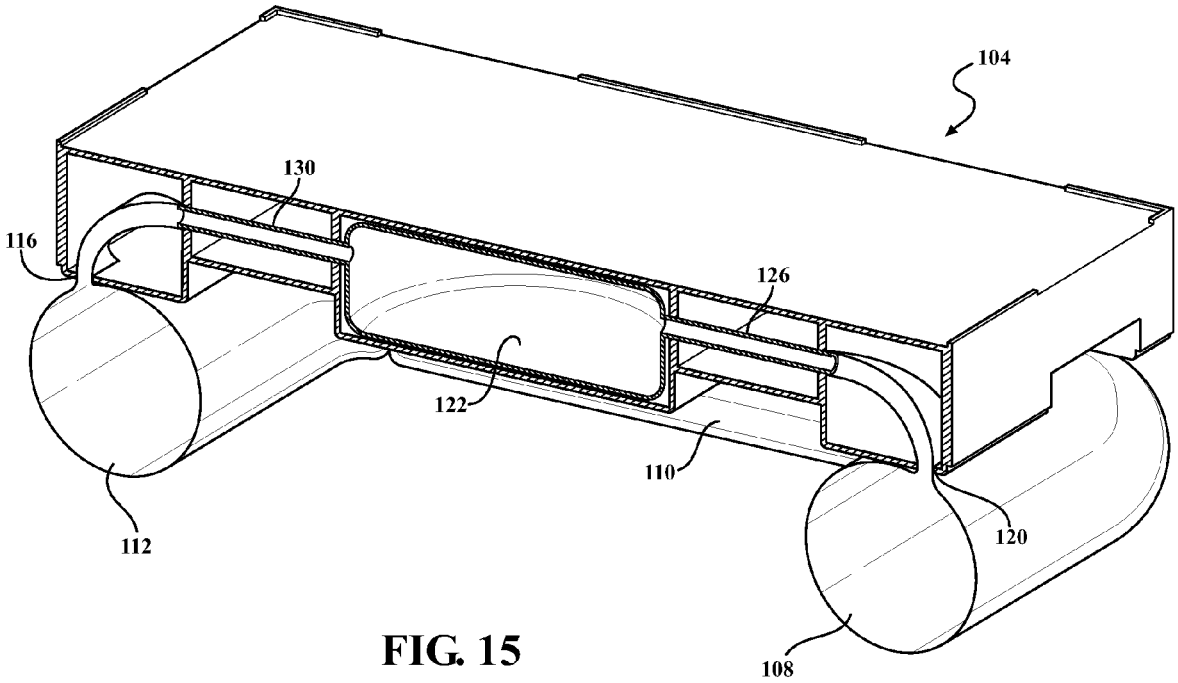
FIG. 15 is an identical cutaway view of FIG. 14, in the expanded position of FIG. 12, and illustrating the configuration of the expanded bladders which are again designed to bias in end-to-end deployed and perimeter surrounding fashion.

Specifically, comparison of FIGS. 10 and 15 best illustrates the manner in which the slot and/or bladders can be redesigned or reconfigured to modify the geometry of the deployed bladders from the generally bottom/side (FIG. 10) to bottom/downward (FIG. 15) deployed and ballast supporting geometry. As with the prior embodiments, the bladders in their pre-expanded position are connected to a central located compressed air or $CO^2$ charged cylinder, tank or canister, see as shown at 122, by a plurality of communicating lines 124, 126, 128 and 130.

Figure 16:
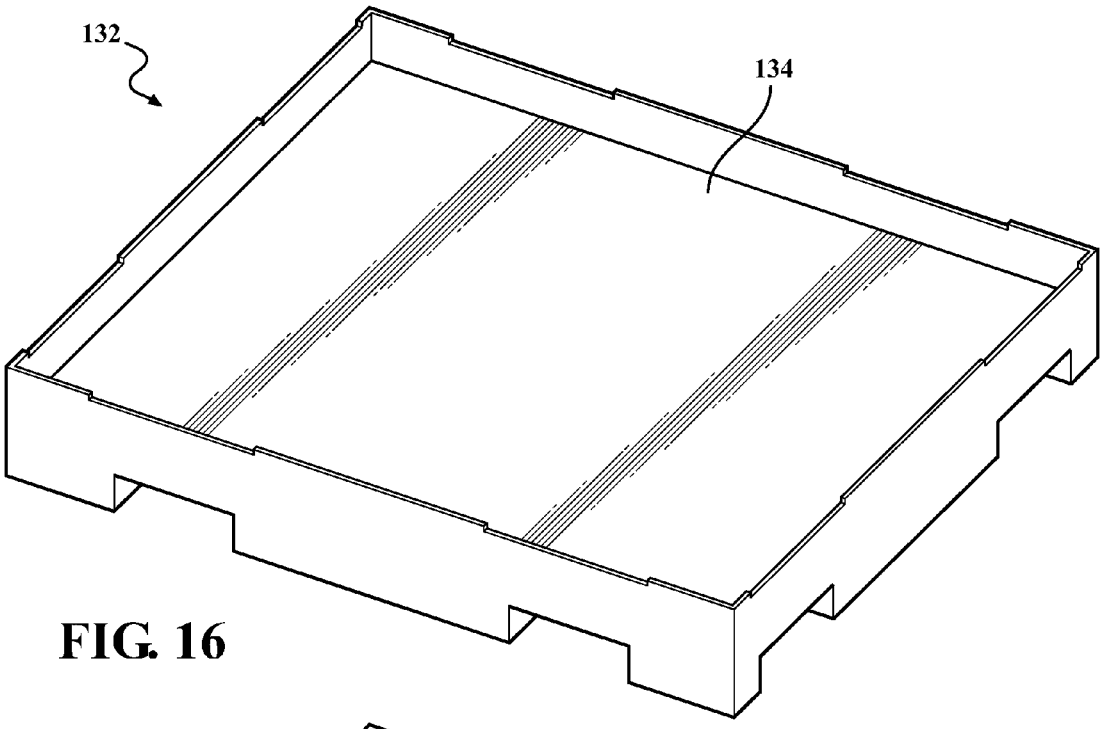
FIG. 16 is a perspective view of a buoyant inflatable pallet construction in a pre-expanded position according to a further sub variant of the invention and in which an upper surface is at a first recessed location within a four sided support frame.
Figure 17:
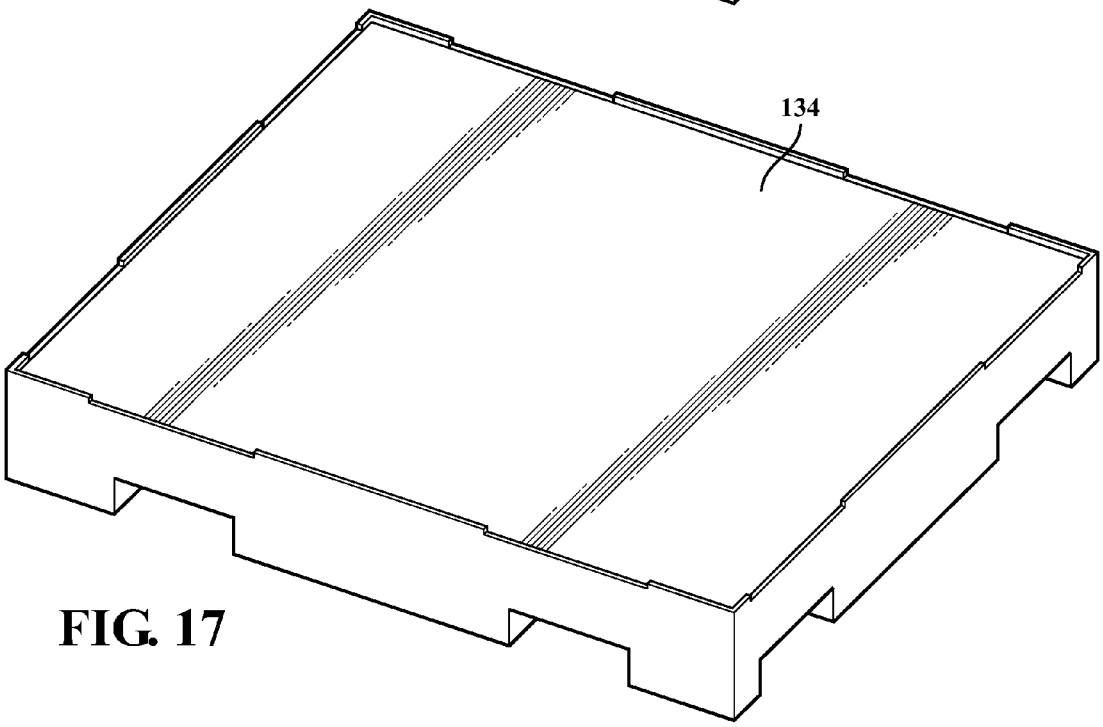
FIG. 17 is a succeeding perspective illustrating the upper surface in an upwardly displaced and expanded position in which it is positioned relatively flush with the extending frame edges of the supporting body.

FIG. 16 is a perspective view at 132 of a buoyant inflatable pallet which is again generally identical to the construction associated with the previously described variant of FIG. 1 with the exception that associated upper surface 134 is originally configured in a pre-expanded (i.e. recessed) position relative to the remainder of the pallet design with collectively defines a four sided and depth extending support frame. FIG. 17 is a succeeding perspective illustrating the upper surface 134 in an upwardly displaced and expanded position in which it is positioned relatively flush with the extending upper frame edges of the supporting body.

Figure 18:
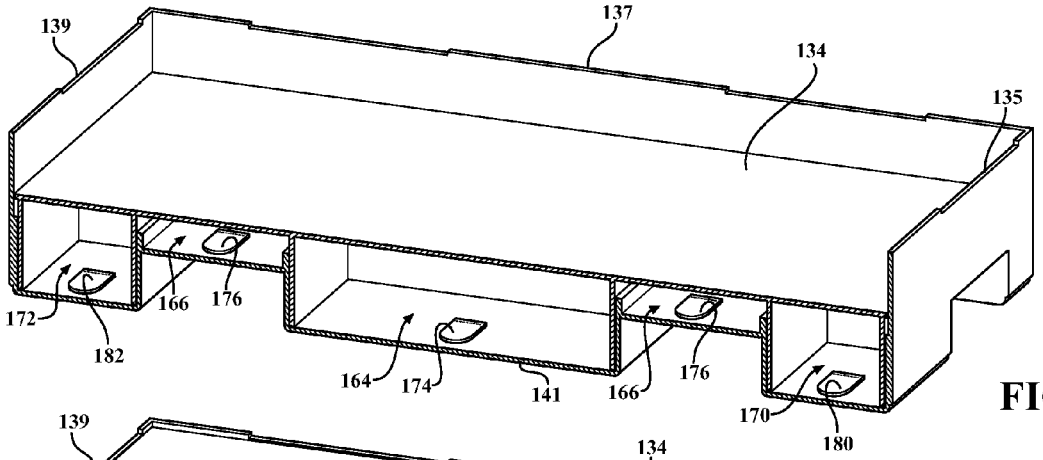
FIG. 18 is a lengthwise cutaway of FIG. 16 and showing the interior architecture of the pallet.
Figure 19:
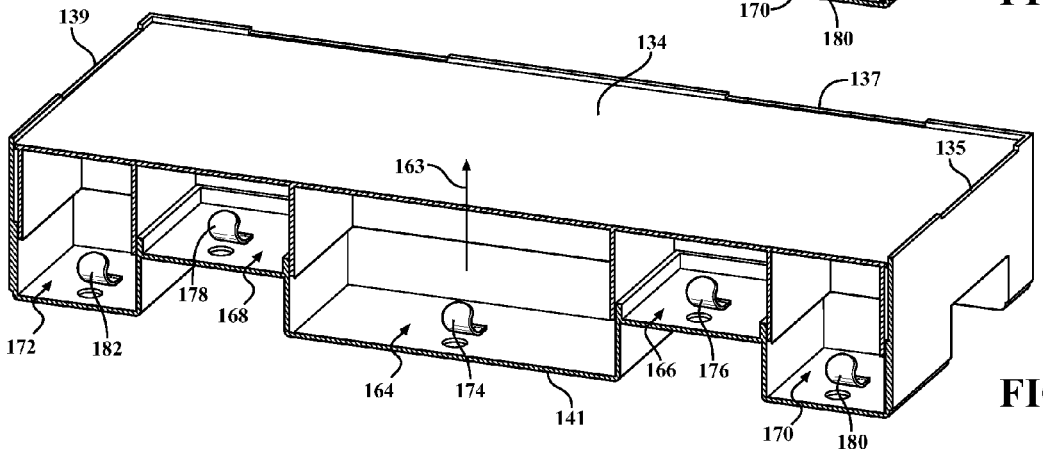
FIG. 19 is a succeeding illustration of the internal architecture cutaway in FIG. 18 and showing the upper surface in the upwardly expanded/deployed position of FIG. 17.
Figure 20:
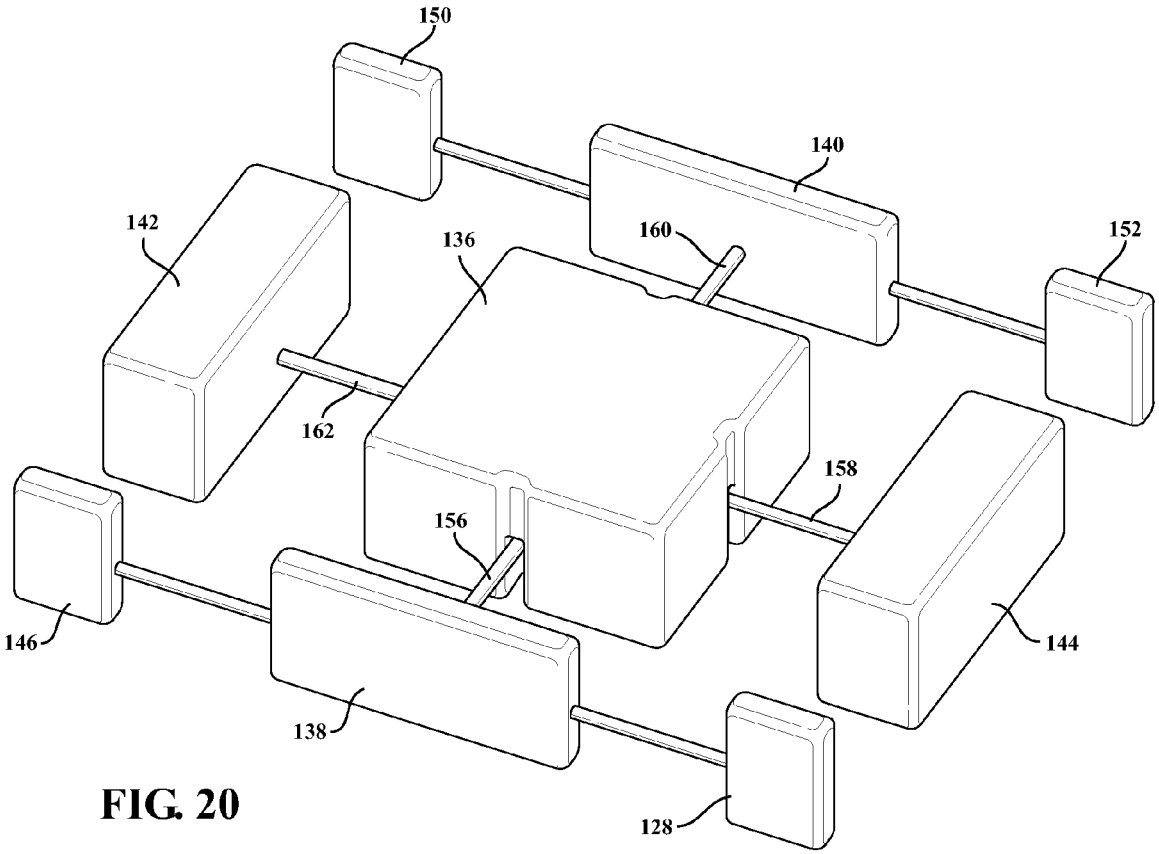
FIG. 20 is a perspective illustration of a network of deployable bladders which can be configured within the pallet construction of FIG. 16 in order to deploy the upper surface.

FIGS. 18 and 19 present lengthwise cutaway interiors of the pallet, corresponding respectively to FIGS. 16 and 17, and by which the expansion of the upper surface 134 is facilitated by a series of internal compartments defined in the pallet construction. FIG. 20 is a perspective illustration of a network of pre-deployed bladders, including central bladder 136 and interconnected perimeter extending network 138, 140, 142, 144, 146, 148, 150 and 152 which can be configured within the pallet construction of FIG. 16 in order to deploy the upper surface 134 to its upper displaced position. As with prior embodiments, the bladders in their pre-expanded position are connected to a central located compressed air or $CO^2$ charged cylinder, tank or canister, see as shown at 154 in FIGS. 21 and 22, by a plurality of communicating lines 156, 158, 160 and 162.

Figure 21:
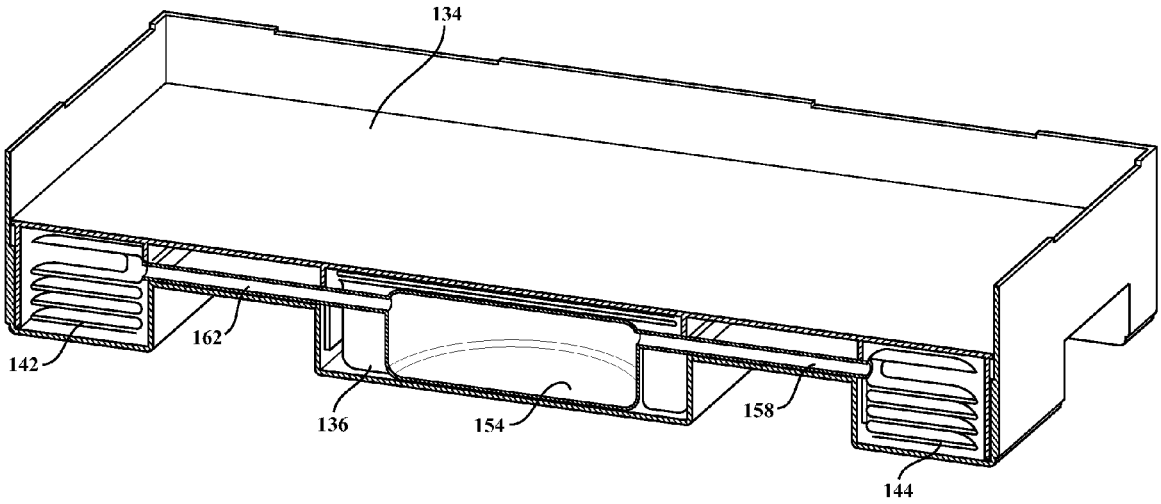
FIG. 21 is a lengthwise cutaway illustration of the buoyant pallet in FIG. 16 and in which the bladder network is incorporated into its interior architecture in an initial pre-deployed position and which further illustrates a fluid charged tank or cylinder encapsulated within a central bladder component.
Figure 22:
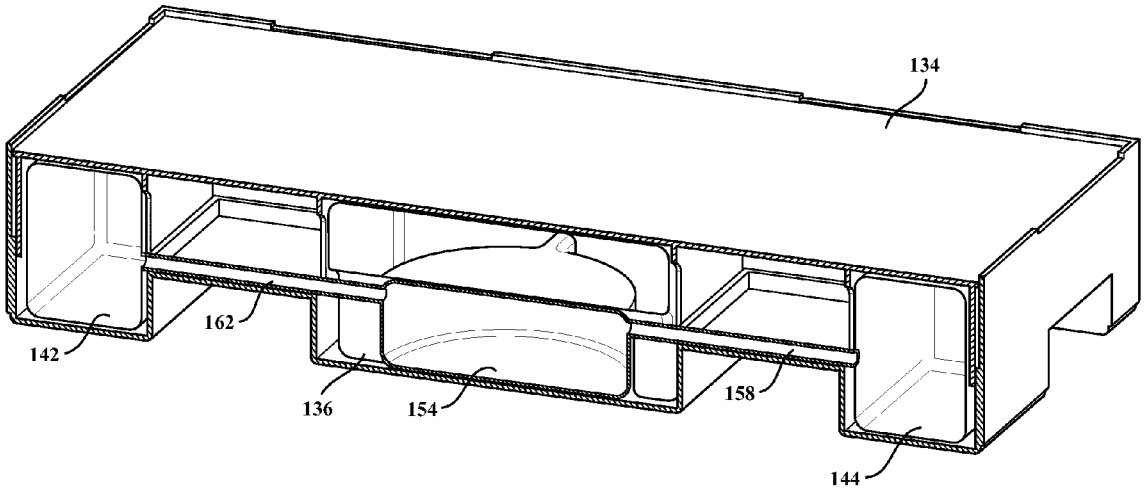
FIG. 22 is a succeeding illustration in cutaway of the pallet in the upwardly deployed position of FIG. 17.

FIG. 21 is a lengthwise cutaway illustration of the buoyant pallet in FIG. 16 and in which the bladder network is incorporated into its interior architecture in an initial pre-deployed position and which further illustrates the fluid charged tank or cylinder 154 encapsulated within a central bladder component. FIG. 22 is a succeeding illustration in cutaway of the pallet and in which the bladders area actuated to their upwardly deployed positions.

The embodiment 132 of expansible pallet construction contemplates a number of operative variants, such as including in a first instance the manual elevation of the upper surface 134 (this constituting a first or upper half of the pallet body) from its recessed and downwardly displaced position relative to upper defined perimeter edges 135, 137, 139 et seq. of a corresponding lower half 141 (see directional arrow 163 in FIG. 19). Elevation of the upper half as depicted results in the creation of a vacuum effect for drawing air into designed in-feed or one way valve air admitting apertures.

A plurality of inner spaces or volumes are defined at 164-172 defined within the lower body halve, with the valves further being shown at 174-182 in correspondingly placed fashion with respect to bottom disposed surfaces of each of the individual compartments or locations within the lower body half 141. It is further envisioned that the inner pocket spaces or volumes at 164-172 in FIGS. 18 and 19 can be either interconnected or isolated, and which act in cooperation with the disposed valve locations 174-182 for establishing one or more pallet airtight sealing components, thereby creating the desired buoyant effect.

As further best shown in the partial view of FIG. 19A, a partial representation is provided of an air valve construction incorporated into the variant of FIG. 19 and which includes a flexible and unidirectional seal (shaped as a flap with a flexible configuration and secured along an edge thereof to a bottom surface of the lower pallet half) located upon a bottom surface of a representative location of a lower body half. The seal is responsive in a first a vacuum intake opening direction by being retracted upwardly away from a lower situated aperture in the bottom surface of the lower pallet half in order to admit air and to internally pressurize an expanding volume established between the upper and lower halves.

The valve locations are generally shown at 174-182 in FIGS. 18 and 19, with representative valve 174 again shown in FIG. 19A relative to floor defined aperture depicted as an inwardly facing perimeter surface 175. As previously described, the seal 174 is caused to open inwardly during upward displacing motion of the pallet upper surface 134 in order to admit air (this typically occurring prior to loading of cargo and/or placement upon a body of water), the pressurization of the inner spaces 164-172 resulting in the seals maintaining an air-tight relationship with the remaining surfaces of the respective valves 174-182.

Upon the upper half 134 being sufficiently upwardly displaced relative to the lower half 141 resultant internal pressure (this enhanced by the subsequent deposit of load bearing cargo upon the upper surface 134) results in the one way valve 174 rotating shut (see again FIG. 19A) thereby maintaining an inner sealed and buoyant/load bearing interior environment associated with the pallet. It is also envisioned that a fewer number of one way intake valves, such as including any number down to one, can be substituted for the several depicted in FIGS. 18-19, such as which would corresponding to any fewer total number of air-admitting compartments defined between the inter-displaceable upper and lower halves 134 and 141.

Figure 19C:
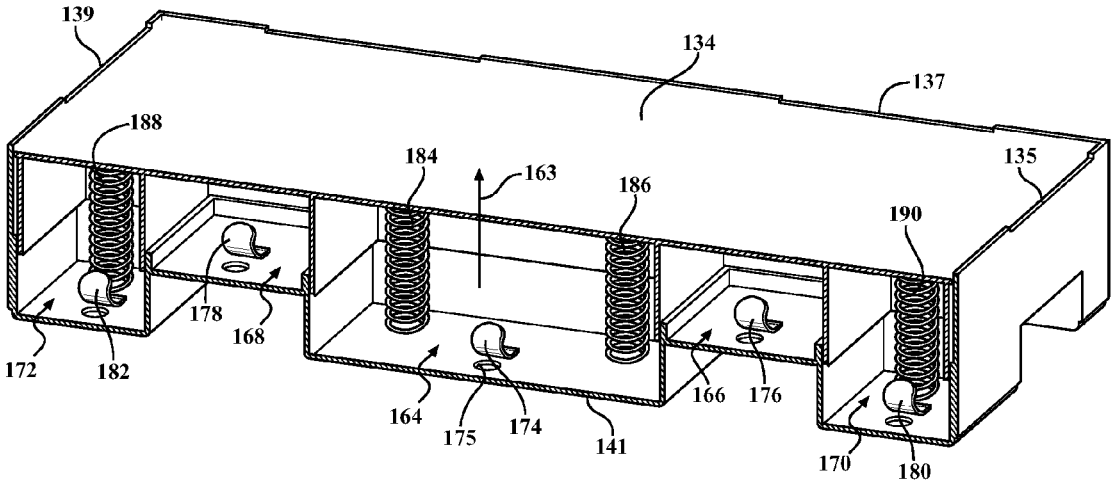
FIG. 19C is a succeeding illustration to FIG. 19B and in which the perimeter catch portions are retracted, causing the compressed springs to expand the upper half in a vacuum inducing elevating fashion, thereby retracting the one way intake valves and pressurizing the pallet body interior in buoyant inducing fashion.

Referring to FIG. 19B, a cutaway illustration similar to FIG. 19 depicts a further potential variant in which a plurality of expandable springs (by non-limiting example represented by springs 184, 186, 188 and 190) are incorporated into the pallet assembly between the upper 134 and lower 141 halves. The halves are maintained in their pre-expanded position by a plurality of perimeter spaced catch or tab portions, examples of which are further shown at 192 and 194, established between the inwardly facing sides 135, 137 and 139 of the lower half 141 and the elevatable outer edges of the upper half 134. FIG. 19C is a succeeding illustration to FIG. 19B, and in which the perimeter catch portions 192 and 194 have been retracted, causing the compressed springs 184-190 to expand the upper half in a vacuum inducing elevating fashion, thereby retracting the one way intake valves and pressurizing the pallet body interior in buoyant inducing fashion.

It is also envisioned that, referring to alternate construction employing the bladder network of FIG. 20, such a bladder network could be maintained within a modified pallet assembly defining the network of inter-configured compartments 164-172 (and without the need for one way air admitting valves). In such an instance, an appropriate triggering mechanism similar to those previously described in the earlier variants can be again employed in order to expand the pallet to the buoyant supporting position. In any variant previously described, it is further envisioned and understood that appropriately configured straps, band or the like can be incorporated into the body for assisting in securing cargo items placed upon the upper supporting surface of the pallet.

Having described my invention, other and additional preferred embodiments will become apparent to those skilled in the art to which it pertains, and without deviating from the scope of the appended claims.

I claim:

1. A flotation pallet, comprising:

a three dimensional shaped body having a plurality of interconnected sides establishing a load supporting surface;

a plurality of buoyancy inducing bladders supported within said body in pre-expanded positions;

a pressurized tank contained within said body and holding a volume of a compressed gas, said bladders connected by a plurality of communicating lines to said pressurized tank; and a plurality of slots formed into extending edges of said body and through which said bladders are collectively expanded in end-to-end perimeter extending fashion relative to said body.

2. The invention as described in claim 1, further comprising said slots formed into at least one of side or underside edges of said body.

3. The invention as described in claim 1, a plurality of perimeter defining bottom edges of said body each exhibiting locating inwardly stepped edge-notches, a corresponding plurality of upper perimeter edges extending ridge sections associated with a second and identically constructed body seating said bottom recessed edge notches of a first body to maintain any plurality of vertically stacked pallets.

4. The invention as described in claim 1, said body being constructed of any of a polymeric or composite material.

5. The invention as described in claim 1, said bladders each being constructed of a flexible, inflatable and puncture resistant material including at least one of a plastic, rubber or composite thereof.

6. A pallet, comprising:

a three dimensional shaped body; and a plurality of bladders supported within said body in first retracted positions and which are deployed in outwardly expanded fashion through openings extending along perimeter extending edges of said body such that said expanded bladders define an end-to-end perimeter contacting and extending arrangement in order to support said body upon a body of water in a buoyant fashion.

7. The invention as described in claim 6, further comprising a pressurized tank holding a volume of a compressed gas and in communication with said deployable bladders.

8. The invention as described in claim 7, further comprising said bladders in their pre-expanded position being retracted within perimeter defined edges of said body and connected by a plurality of communicating lines to said pressurized tank.

9. The invention as described in claim 8, said perimeter extending openings further comprising a plurality of slots formed into at least one of side or underside edges of said body.

10. A pallet, comprising:

a three dimensional shaped body having upper and lower vertically inter-displaceable halves, each exhibiting overlapping and vertically extending walls defining a plurality of individual compartments; and expansion of said upper half relative to said lower half causing said body to establish a buoyant supporting condition when placed upon a body of water.

11. The invention as described in claim 10, further comprising a one way inlet valve disposed within a bottom surface of said lower halve with each of said individual compartments and, upon upward relative displacement of said upper half, causing a flap associated with each of said valves to retract to permit admittance of air into an expanding interior defined between said halves, via vacuum inlet pressure acting upon said valves.

12. The invention as described in claim 10, further comprising an interconnected network of deployable bladders being supported within said compartments and, upon actuating, outwardly displacing said upper half relative to said lower half to establish a buoyant supporting condition when placed upon a body of water.

13. The invention as described in claim 11, further comprising a plurality of expandable springs incorporated into each of said compartments established between said upper and lower halves, said halves being maintained in a pre-expanded position by a plurality of tabs projecting from elevated and inwardly facing sides of said lower half which are in abutment with elevatable outer edges of said upper half, retraction of said tabs causing exertion of said springs to expand said upper half in combination with retracting said one way intake valves and pressurizing the pallet body interior in buoyant inducing fashion.

* * * * *